US005186519A

United States Patent [19]

Larson

[11] Patent Number: 5,186,519

[45] Date of Patent: Feb. 16, 1993

[54] WORKPLACE CHAIR

[76] Inventor: John E. Larson, P.O. Box 1607, Hamilton, Mont. 59840

[21] Appl. No.: 613,306

[22] Filed: Nov. 15, 1990

[51] Int. Cl.[5] ..... A47C 7/50

[52] U.S. Cl. ..... 297/423; 297/338; 297/353; 297/460

[58] Field of Search ..... 297/423, 429, 437, 92, 297/232, 244, 257, 460, 338, 339, 345, 353

[56] References Cited

U.S. PATENT DOCUMENTS 4,589,699 5/1986 Dungan ..... 297/423

FOREIGN PATENT DOCUMENTS 3227519 2/1983 Fed. Rep. of Germany ..... 297/423

0000016 1/1988 World Int. Prop. O. ..... 297/423

*Primary Examiner*—Peter R. Brown

*Attorney, Agent, or Firm*—Harry M. Cross, Jr.

[57] ABSTRACT

An adjustable chair comprises a front seat assembly, a rear seat assembly, and a base assembly, the base assembly supporting the front and rear seat assembly independently of one another. The front seat assembly has a front seat pivotally mounted for rotation about a horizontal axis. The rear seat assembly has a rear seat pivotally mounted for rotation about a horizontal axis. The two rotation axes are separated from one another a sufficient distance that a person may sit on the front seat and position his or her back against the rear seat. Each seat is pivotally mounted by its respective seat assembly such that the rotation axis for each seat is located at a fulcrum point from which the seat is pivotally supported.

22 Claims, 5 Drawing Sheets

FIG.5
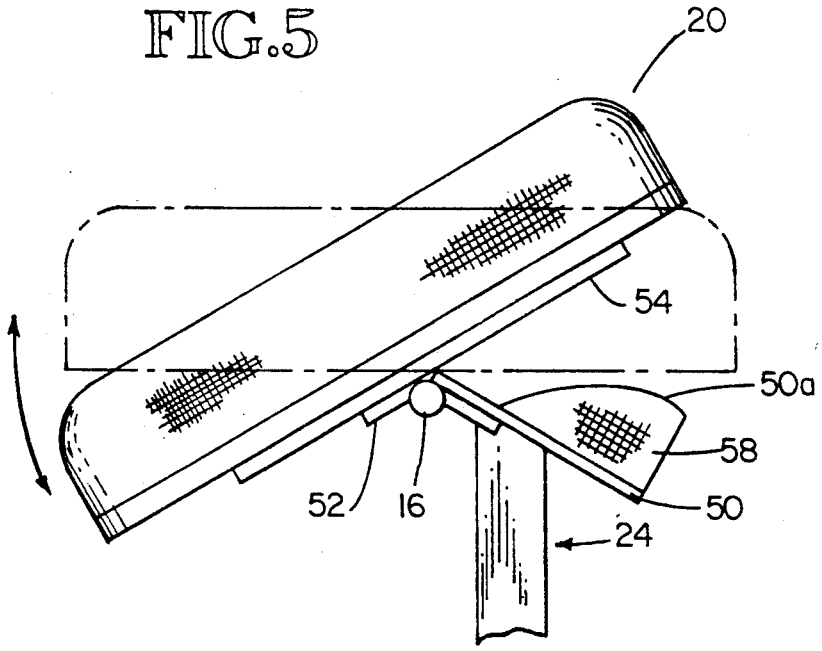
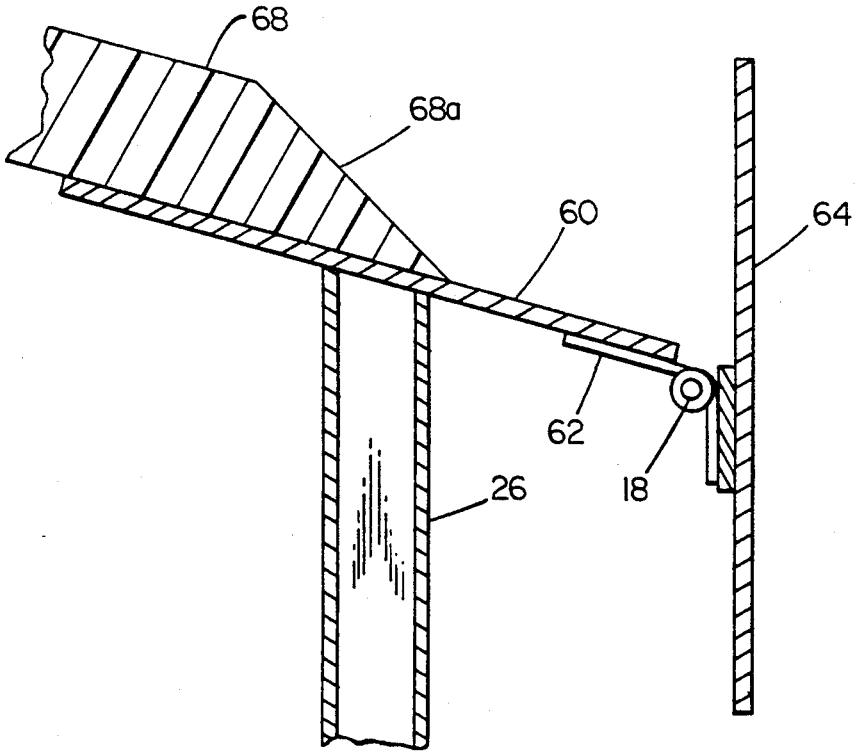
FIG.6

WORKPLACE CHAIR

FIELD OF THE INVENTION

This invention relates to adjustable chairs for the industrial and office environment.

BACKGROUND OF THE INVENTION

Seated workers in the industrial and office environment often experience back pain and other physiological difficulties as a result of prolonged sitting in a fixed posture. Much research and analysis has been conducted into so-called ergonomic chair design to provide solutions to these difficulties.

Four principal chair designs have been identified and theories have been developed to support each design as solving some seating difficulty. Chairs embodying these designs are available in the market place. One such design provides a flat, horizontal seat pan and a vertically-upright back, enabling a worker to sit with his or her thighs and back at a 90 degree angle to one another. A second chair design, often called a "Mandal" chair provides a seat pan having a forward, downward tilt with an upright back. A third chair design, often called a "Grandjean" chair, provides a back having a backward tilt with a horizontal seat pan. A fourth chair design, often called a "Balans" chair, provides a seat pan having a forward tilt with a knee rest having a backward tilt. A fifth chair design, often called a "standing" chair, provides an elevated seat pan having a forward tilt for a worker that would be partially sitting and standing at the same time; as one might do at a drafting table. All of these designs can be provided with adjustable seat pans and, where used, adjustable back rests having heights to accommodate workers of different body builds and to accommodate different working environments. There appear to be clear advantages and disadvantages to all five postural options afforded by these five chair designs.

All five designs are intended to restore lumbar lordosis to the seated worker, and thereby reduce the pressure on lumbar disks that is a root cause of lower back pain. The various theories simply represent a disagreement as to how restoration of lumbar lordosis might best be achieved. In actual testing of these chair designs, however, researchers have discovered the workers exhibit so-called idiosyncrasies in seated posture; that is to say, workers exhibit working seated postures that do not conform to any of the theories, and that these idiosyncrasies will be influenced by individual variations in both weight and physical fitness of a worker's body parts. In other words, workers do not always sit the way the researchers think and suggest that they ought. It has been concluded that actual sitting behavior is subject to individual variability because of variations in body build, personal habit and personal preference, and training. Seating postures can also be affected by the working environment; whether a worker is engaged at a drafting table, microscope, computer terminal, and so forth. Furthermore, it has been concluded that various physiological recommendations as to appropriate seating postures can be at odds with one another. For example, seating postures that are best for maintaining spinal lordosis may not be the most comfortable or healthy if blood supply to the lower legs is restricted. Workers, for example, when given an opportunity to pick their most comfortable sitting posture, do not always choose a sitting posture that achieves lordosis.

It has been suggested, therefore, that a suitable chair, in order to fit into its working environment, should be adjustable in the following ways: (1) the seat height should be adjustable; (2) seat depth should be adequate for large people without being too large for smaller workers; (3) seat padding should be adequate to allow pressure to be distributed but not so soft that the seat bones of the pelvis (the ischial tuberosities) bottom out; (4) the seat pan should be capable of tilting forward and backward; (5) the back should be alternately positionable both upright and with a backward tilt; (6) the backrest should be padded and have a lumbar support; (7) the chair should have both a dynamic range of posture movements without the worker making adjustments, and multiple static posture settings which can be engaged to lock the chair into any position set by the worker.

SUMMARY OF THE INVENTION

A major object of the present invention is to provide an ergonomic workplace chair that maximizes the objectives of the above-suggested adjustabilities. A further major object is to provide a chair that provides the aforementioned postural options, each with a dynamic range of posture movements. Another object of this invention is to provide such a chair that is capable of being set to provide the five aforementioned postural options; upright (the upright chair), backward-tilted backrest (the "Grandjean" chair design), forward tilted seat pan (the "Mandal" chair design); knee-supported (the "Balans" chair design); and the "standing" chair. A further object of this invention is to provide such a chair that may permit a worker to assume other postures as might be desired for working, resting or lounging. Still another object of this invention is to provide such a chair that might be used in environments other than in the workplace and at a work station.

An adjustable chair in accordance with this invention comprises a front seat assembly means, a rear seat assembly means, and a base assembly means, the base assembly means supporting the front and rear seat assembly means independently of one another. The front seat assembly means has a front seat pivotally mounted for rotation about a horizontal axis. The rear seat assembly means has a rear seat pivotally mounted for rotation about a horizontal axis The two rotation axis are separated from one another a sufficient distance that a person may sit on the front seat and position his or her back against the rear seat. Each seat is pivotally mounted by its respective seat assembly means such that the rotation axis for each seat is located at a fulcrum point from which the seat is pivotally supported.

In a preferred embodiment of the chair of this invention, the position of the front seat, when used as a seat by a sitting worker, depends on where the worker positions his or her seat with respect to the front seat's fulcrum point. For example, if the sitter locates his or her seat directly over the fulcrum point, the chair seat will tend to establish a horizontal position; if the sitter locates his or her seat to the rear of the fulcrum point, the seat will tend to establish a rearward-tilted position; and if the sitter locates his or her seat forward of the fulcrum point, the seat will tend to establish a forward-tilted position.

In a preferred embodiment of the chair of this invention, the position of the rear seat, when used as a back rest by a sitting worker, depends on the relative heights of the two fulcrum points and on where the sitter locates his or her seat on the chair seat. For example, if the sitter locates his or her seat on the chair seat so that the chair seat tends to assume a rearward-tilted position, the sitter's back will fall back against the rear seat (back rest) as the sitter sits in the chair, and the seat back will bear against the sitter's back at a backward tilted angle; in a modified "Grandjean" posture. In the chair of this invention, the rear seat has a sufficient length, above and below its fulcrum point, that the sitter's back in the present example will be contacted and supported by the rear seat above and below the rear seat fulcrum point; more particularly, the sitter's dorsal region will be contacted and supported above this fulcrum point and the sitter's sacrum region will be contacted and supported below this fulcrum point. Consequently, as the sitter sits back in the chair, against the rear seat (back rest), the sitter's upper back will contact the upper portion of the rear seat and lever it about the rear seat fulcrum point into supporting contact with the sitter's lower back. As a worker engages in the work at hand, he or she will naturally adjust and change sitting positions, often times only very slightly. As a consequence of the interrelationship of the front and rear seat fulcrum points, the worker's sacrum region will be supported, the worker's own back serving to actuate a levering action of the rear seat about its fulcrum point to apply forward pressure on the worker's sacrum region. If the worker shifts forward on the front seat, the front seat will rotate forwardly about its fulcrum point and the rear seat will rotate rearwardly about its fulcrum point, and the lower part of the rear seat will still be levered against the worker's sacrum region. (If the worker causes the seat pan to assume a horizontal position and the back seat to assume a vertical position, he or she has assumed the classic "Grandjean" posture). It the worker shifts rearward on the front seat, the front seat will rotate rearwardly about its fulcrum point and the rear seat will rotate forwardly about its fulcrum point, and the lower part of the rear seat will still be levered against the worker's buttocks (sacrum) region. The worker's sacrum region is at all times contacted by the lower end of the rear seat when the worker sits back against the rear seat (back rest).

In the preferred embodiment of the chair of this invention, the position of the rear seat, when used as a sitting element by a worker sitting in the Balans position, depends on the relative heights of the two fulcrum points and on where the sitter locates his or her seat on the chair's rear seat. For example, if the sitter locates his or her seat on the chair's rear seat so that the chair's rear seat tends to assume a forward tilted position, and positions his or her knees on the chair's front seat, the sitter's back will be born upright with spinal lordosis in the Balans posture; the chair's front seat being at a backward tilted angle. In the chair of this invention, the rear seat has a sufficient length, above and below its fulcrum point, that the sitter's seat bones (ischial tubersoties) will be contacted and supported by the rear seat opposite the rear seat fulcrum point; and the sitter's knees will be contacted and supported by the front seat opposite the front seat fulcrum point; with the rear and front seats inclined in a plane generally parallel to the plane of the sitter's seat and upper shins, respectively. As a worker engages in the work at hand, he or she will naturally adjust and change sitting positions, often times only very slightly. As a consequence of the interrelationship of the front and rear seat fulcrum points, the worker's seat region (around the ischial tuberosities) will be supported, and yet the worker is able to rock the rear and front seats about their fulcrum points to adjust his or her posture. If the worker shifts forward on the front seat so that the force applied by the knees is forward of the fulcrum point, the front seat will rotate forwardly about its fulcrum point to bear against the worker's upper shins and the rear seat will rotate about its fulcrum point to adjust to the postural shift. If the worker shifts rearward on the front seat, the front seat will rotate rearwardly about its fulcrum point to lessen the pressure on the worker's shins and the rear seat will rotate correspondingly about its fulcrum point. The worker may shift his or her position on the rear seat to locate his or her ischial tuberosities from opposite to the rear seat fulcrum point, either forwardly or rearwardly, thereby causing a pivoting of the rear seat about its fulcrum point and affecting the force of, and location where, the worker's knees contact the front seat; and the front seat will rotate about its fulcrum point to a to the postural shift.

BRIEF DESCRIPTION OF THE DRAWINGS

FIG. 5 is a side elevation view of an exemplary front seat assembly as might be incorporated into the FIGS. 1 and 2 embodiments;

FIG. 6 is a side elevation view of an exemplary rear seat assembly as might be incorporated into the FIGS. 1 and 2 embodiments;

DETAILED DESCRIPTION OF THE INVENTION

Figure 1:
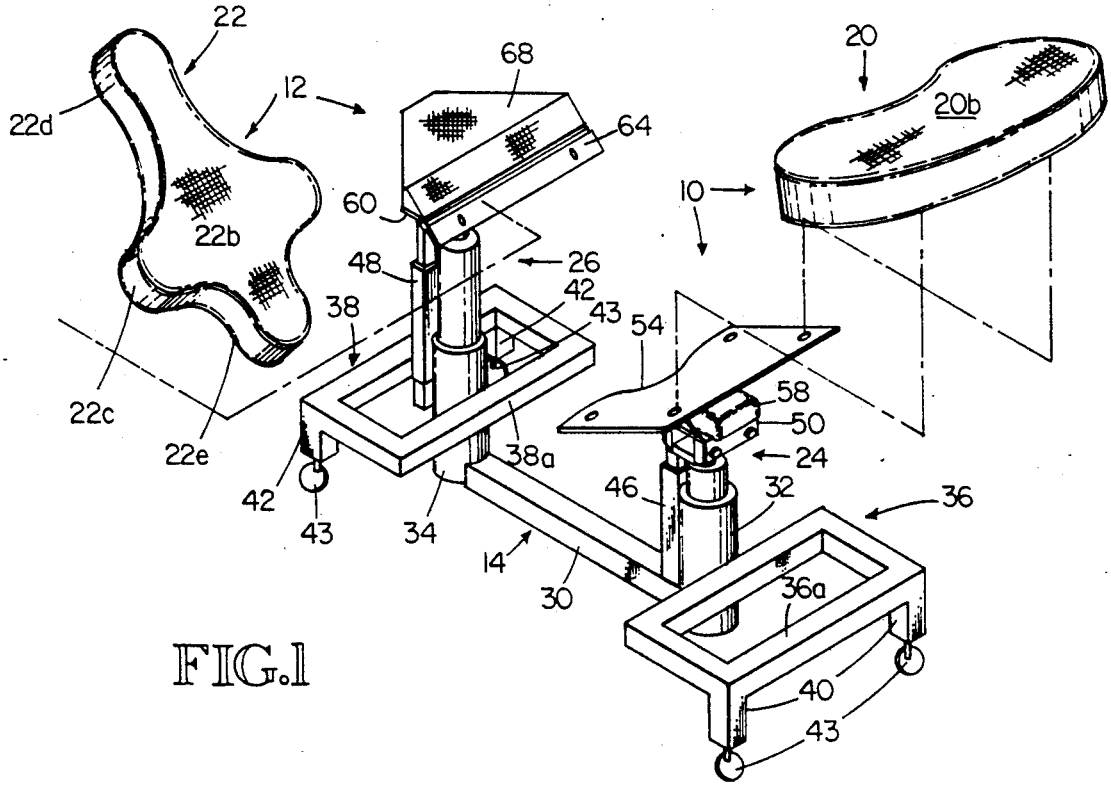
FIG. 1 is a perspective view, partially exploded, showing one embodiment of the invention.

The chair of this invention comprises a front seat assembly 10, a rear seat assembly 12, and a base assembly 14. The base assembly supports the front and rear seat assemblies and spaces them apart. The front seat assembly is mounted to the base assembly and provides a front seat 20 capable of pivotal movement about a horizontal axis 16. The rear seat assembly is mounted to the base assembly and provides a rear seat 22 capable of pivotal movement about a horizontal axis 18. The base assembly mounts the front seat assembly by means of a telescopically adjustable upright front mounting assembly 24. The base assembly mounts the rear seat assembly by means of a telescopically adjustable upright rear mounting assembly 26. Thus, the heights of the front and rear seat assemblies are independently adjustable. The front and rear mounting assemblies may be manually adjustable, as shown with reference to FIGS. 2 and 4, or they may be pneumatically adjustable, as shown with reference to FIGS. 1 and 3.

The base assembly comprises a main horizontal steel member, which may be a steel bar 30 as shown in FIG.

Figure 2:
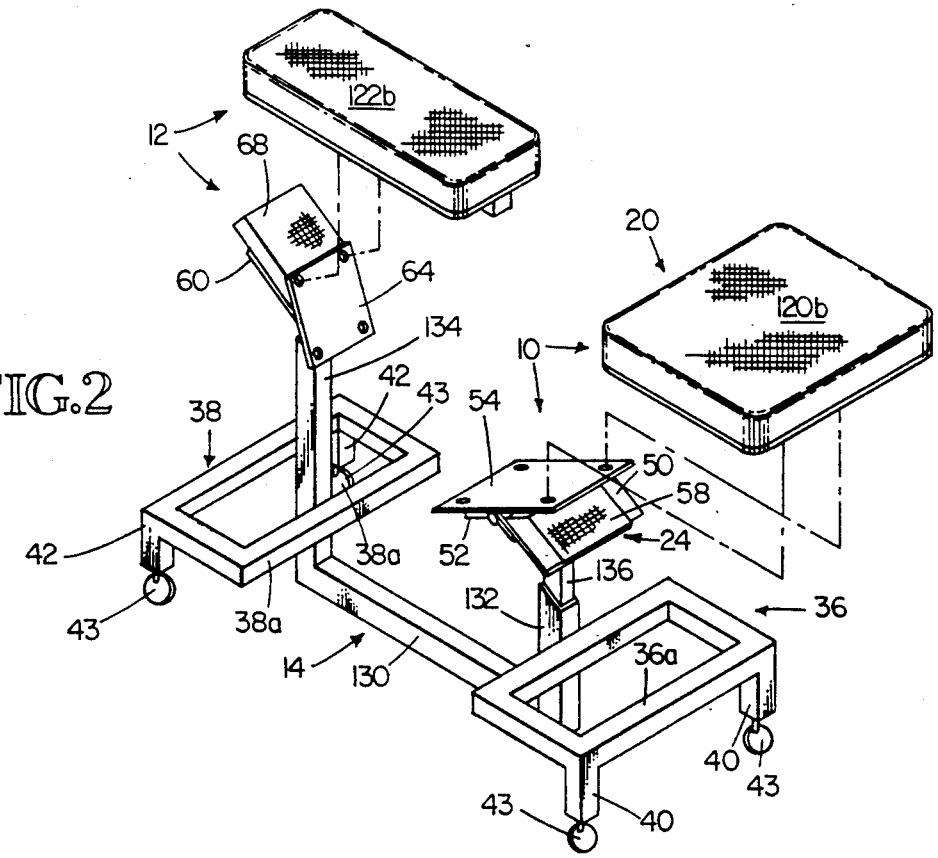
FIG. 2 is a perspective view, also partially exploded, showing another embodiment of the invention.

1 or a steel tube 130 as shown in FIG. 2; front and rear upright steel extension lift sleeves, which may be steel cylinders 32–34 as shown in FIG. 1 or steel tubes 132–134 as shown in FIG. 2, welded to and extended upwardly from the main horizontal member 30, or 130; and front and rear floor support frames 36–38 which may be steel tubes welded into a rectangular framework with depending front and rear pairs of legs 40–42. The legs may mount floor castors 43 which elevate the front and rear floor support frames so that main horizontal member 30, or 130, will just clear the floor on the order of about ¾ inch (providing just enough clearance to clear the loft of any carpeting on which the chair is placed). The front floor support frame is welded to the front side of the extension lift sleeves 32 or 132, and extends forward, ahead of the front seat mounting assembly 24 as shown in FIGS. 1 and 2. The rear floor support frame is welded to the front side of the extension lift sleeves 34 or 134, and extends rearward, behind the rear seat mounting assembly 26 as shown in FIGS. 1 and 2. The width of the support frame rectangles is sufficient to provide lateral stability for the chair against tipping over; about 15 inches being adequate. The front floor support frame provides a front cross-rail 36*a* that may double as a foot rest, at an elevation of about 5–6 inches for example. Likewise, the rear floor support frame provides a forward cross-rail 38*a* that may double as a heel rest, at an elevation of about 5–6 inches for example. The main horizontal member 30, or 130, is a structural beam that locates the front and rear mounting assemblies, front to rear, at a desired distance apart; about 17 inches being adequate. It is preferable that the base assembly 14 include structure providing an elevated foot support cross-rail such as rail 36*a*, but neither it nor heel cross-rail 38*a* are necessary. The elevated front and rear floor support frames enable the use of the four depending legs 42 which provide for stable 4-point floor support; the small degree of elevation of the main horizontal member 30, or 130, preventing "high centering" of the chair.

Figure 3:
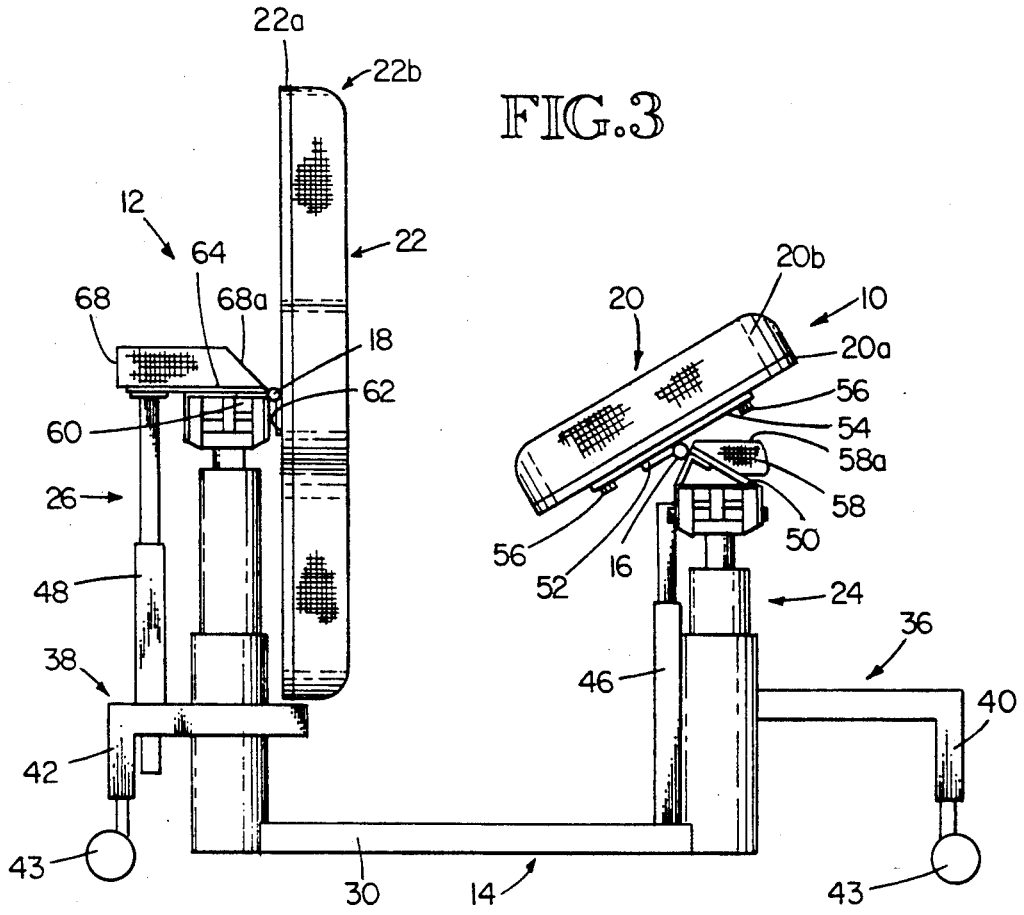
FIG. 3 is a side elevation view of the FIG. 1 embodiment.

In the case of the front and rear mounting assemblies shown in the FIG. 1 embodiment, the front and rear mounting assemblies, 24–26, are top-actuated gas lift columns or assemblies, each comprising a gas cylinder and cylinder rod atop which is mounted a lever-actuated gas flow control valve. The cylinder portion of each gas lift column is inserted within and carried by the respective steel sleeve 32–34. The front and rear seat assemblies are mounted to the upper end of the respective gas lift column or assembly. These gas lift columns are designed to telescopically retract on application of a significant downward-applied force greater than a preset amount when the lever actuator is toggled, and to telescopically extend when the lever actuator is toggled in the absence of a significant downward-applied force. The size of each gas lift column is selected so that the front seat pivot point 16 may be adjusted between a suitable range of about 0 to 6.5 inches, and the rear seat pivot point 18 may be adjusted between a suitable range of about 0 to 10 inches. The gas lift columns currently available employ cylindrical cylinder rods that are not indexed against rotation. Therefore, to eliminate swiveling of the front and rear seat assemblies relative to the base assembly, auxiliary front and rear telescoping anti-rotation stabilizers 46–48 are mounted by the base assembly as shown in FIGS. 1 and 3 and to one of the front and rear seat assemblies to prevent swiveling of the front and rear seat assemblies.

In the case of the front and rear mounting assemblies shown in the FIG. 2 embodiment, the front and rear mounting assemblies, 24–26, are steel tube posts 136–138, each telescopically inserted into a respective steel tube 132–134. The relative telescopic position of each steel tube post 136 or 138 is adjustable and maintained by a retaining pin 140–142 mounted by the respective tube 132 or 134. The retaining pin may by releaseably engageable with notches countersunk into the respective tube post 136 or 138, or otherwise engageable therewith to hold whatever extended position is required. The size of each tube post is selected so that the front seat pivot point 16 may be adjusted between a suitable range of about 0 to 12 inches, and the rear seat pivot point 18 may be adjusted between a suitable range of about 0 to 20 inches. The front and rear seat assemblies are each mounted to the top of a respective tube post. The steel tubing 132–134 and the tube posts 136–138 are preferably of square cross section so that the front and rear set assemblies will not swivel relative to the base assembly.

The front seat assembly 10 comprises a hinge plate 50 that is secured to the top of the front mounting assembly 24 at a downward angle of about 45 degrees from horizontal. The hinge plate mounts, at its upper rearwardmost end, a hinge mechanism 52. This hinge mechanism may comprise a pair of spring-loaded hinges located one on either side of the vertical telescopic axis of the front mounting assembly 24. The hinge mechanism 52 mounts a seat plate 54, the hinge mechanism pivot axis defining the pivot axis 16, and is designed to rotate through an arc of about 135 degrees. The front seat hinge pivot axis defines the front seat fulcrum point. The spring-loaded hinge may be biased to rotate the seat plate 54 backward and down to vertical; or it may be biased to rotate the seat plate forward and down toward the hinge plate 50. The front seat 20 is attached to the seat plate 54 in a manner such that its position, relative to the seat plate, may be adjusted forward or rearward for a total adjustment distance of about 5 inches. This adjustability may be provided by providing a series of bolt holes in the bottom of the seat 20 so that bolts 56 may be located in forward or rearward set of holes, or an adjustable rack may be provided so that a more convenient form of adjustment may be made.

The rear seat assembly 12 comprises a hinge plate 60 that is secured to the top of the rear mounting assembly 26 horizontally (FIG. 3) or at a downward angle of about 25 degrees from horizontal; either fore or aft, i.e. sloping either toward the front or to the rear. The hinge plate mounts, at its frontwardmost end, a hinge mechanism 62. This hinge mechanism may comprise a pair of spring-loaded hinges located one on either side of the vertical telescopic axis of the rear mounting assembly 26. The hinge mechanism 62 mounts a seat plate 64, the hinge mechanism pivot axis defining the pivot axis 18, and is designed to rotate through an arc of about 125 degrees. The rear seat hinge pivot axis defines the rear seat fulcrum point. The spring-loaded hinge may be biased to rotate the seat plate 64 backward and down toward the hinge plate 60; or it may be biased to rotate the seat plate forward and down to vertical.

If one or both seat plate hinge mechanisms 52–62 are biased to swing the respective seats 20–22 to vertical, a worker may slip sideways between the two seats, stepping across the main horizontal member 30, or 130, in the process, to position himself or herself between the two seats. Then the worker can easily assume the "Balans" posture shown in FIG. 8, or the standing seat posture. There is thus an advantage to having the hinge mechanisms biased in this manner. For assuming other postures, it may be desirable to arrange the hinge mechanism biases oppositely.

The front and rear seat assemblies are each provided with a foam cushion pad 58, 68 mounted to the seat plate to act as a compressible wedge between the respective seat plate and the cushion 20, 22. The wedge is an elastomeric resilient spring that cushions the respective seat; the front seat when sat upon, as in the "Grandjean" and "Mandal" sitting postures; and the rear seat when sat upon, as in the "Balans" sitting posture. A medium hard elastomeric foam, as used in the upholstery and furniture trades, would be suitable. Each resilient spring wedge presents a flat seat-contacting surface, 58*a*, 68*a*, against which the respective seat plate bears when the seat is rotated into contact with the wedge. This location and position of this contact surface, relative to the seat plate, establishes a normal, static position for the respective seat and further rotation into the wedge is resiliently resisted. Thus, each wedge acts as a shock absorber as well as a resilient foam, or elastomeric, spring.

Figure 4:
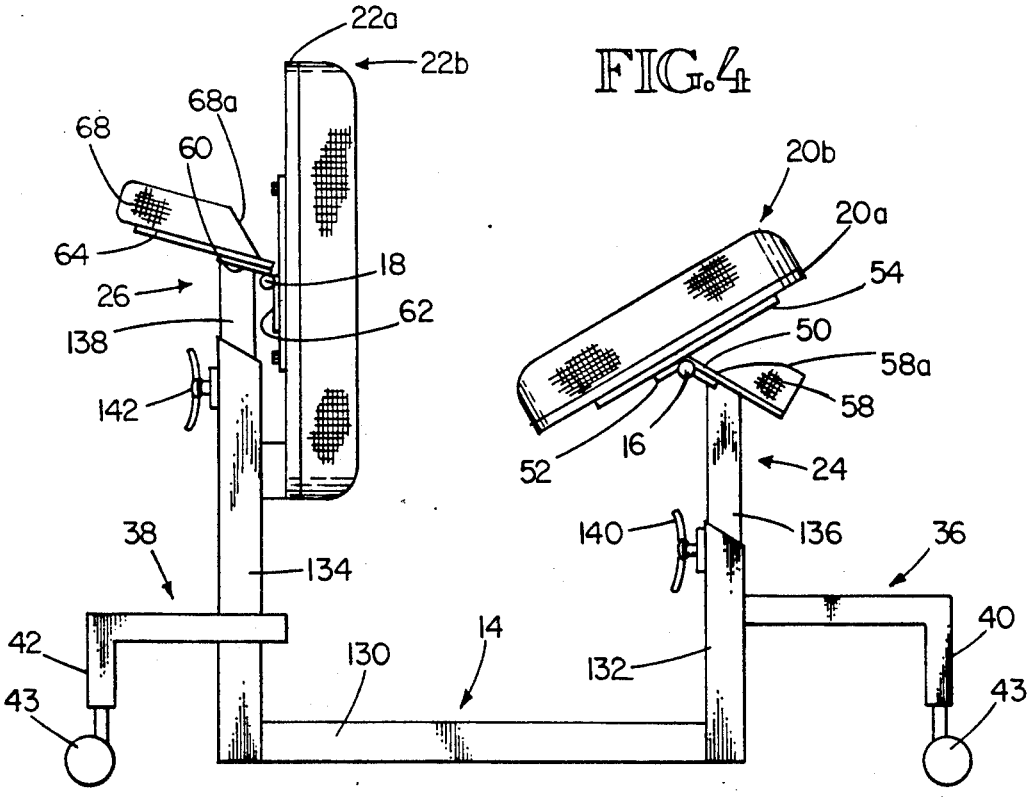
FIG. 4 is a side elevation view of the FIG. 2 embodiment.

The seats 20,22 themselves are provided with a stiff backboard 20*a*, 22*a*, as seen in FIGS. 2 and 4, and an upholstered cushion 20*b*, 22*b*. These cushions may take various forms, such as shown in FIGS. 1 and 2. The forward seat cushion 20*b* (FIG. 1), 120*b* (FIG. 2) is preferably provided in a length, front-to-back, that is short enough that a worker will be able to sit on it in either the "Grandjean" or "Mandal" postures with his or her sacrum (and seat bones, if desired) clear, rearwardly, of the seat cushion and yet having his or her popliteal crease (the back-of-the knee crease) clear, forwardly, of the seat cushion; as shown with respect to the modified "Grandjean" posture in FIG. 7. It is desireable for a worker to be able to position himself or herself on a seat so that his or her sacrum, coccyx, ischial tuberosities (seat bones), or trochanters are clear of bearing contact when seated in one position for long periods of time; as might occur with VDT operators and others.

The FIG. 1 front seat cushion design provides a kidney-shaped configuration with rearwardly-extending lobes and a rearward cutout. The rearward-opening cutout is wide enough thata sitter's ischial tuberosities would clear the seat cushion and also clear the sitter's sacrum. And yet, when used in the Balans mode, the lobes provide good support for the sitter's lower legs in the upper shin region; the cutout between the lobes would not affect a user sitting in the Balans mode. In this configuration, the length from the front seat edge to the base of the cutout would be about 10 inches and the length from the front seat edge to the back edge (i.e. to a line drawn between the back edges of the lobes) would be about 13 inches.

Figure 7:
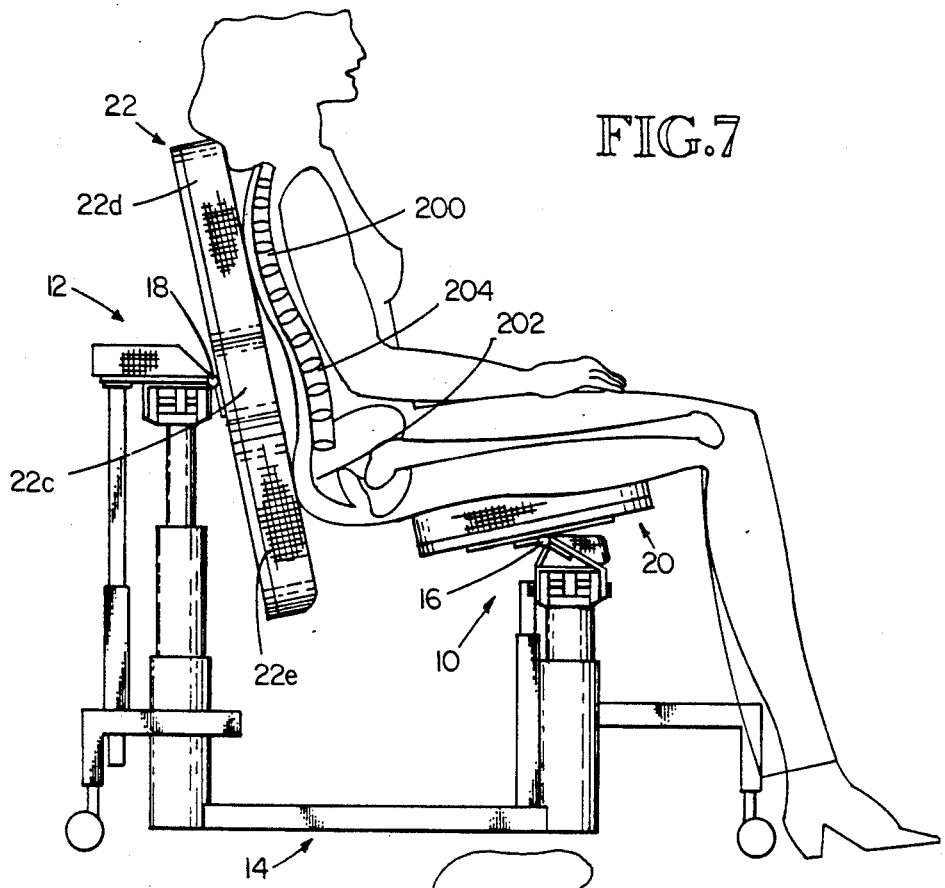
FIG. 7 is a side elevation view of the FIG. 1 embodiment used in a modified "Grandjean" posture mode.

The rearward seat cushion 22*b* (FIG. 1), 122*b* (FIG. 2) is preferably provided in a length, top-to-bottom, that is long enough that a worker will be able to rest his or her back against it in either the "Grandjean" or modified "Grandjean" postures with his or her sacram and dorsal regions of the spine supported, as shown in FIG. 7. Preferably, the rear seat cushion 22*b*, 122*b* is sufficiently narrow in the worker's sacrum and dorsal regions of the spine that swiveling movement of the worker's hips and shoulders is not encumbered by contact with the cushion.

Figure 8:
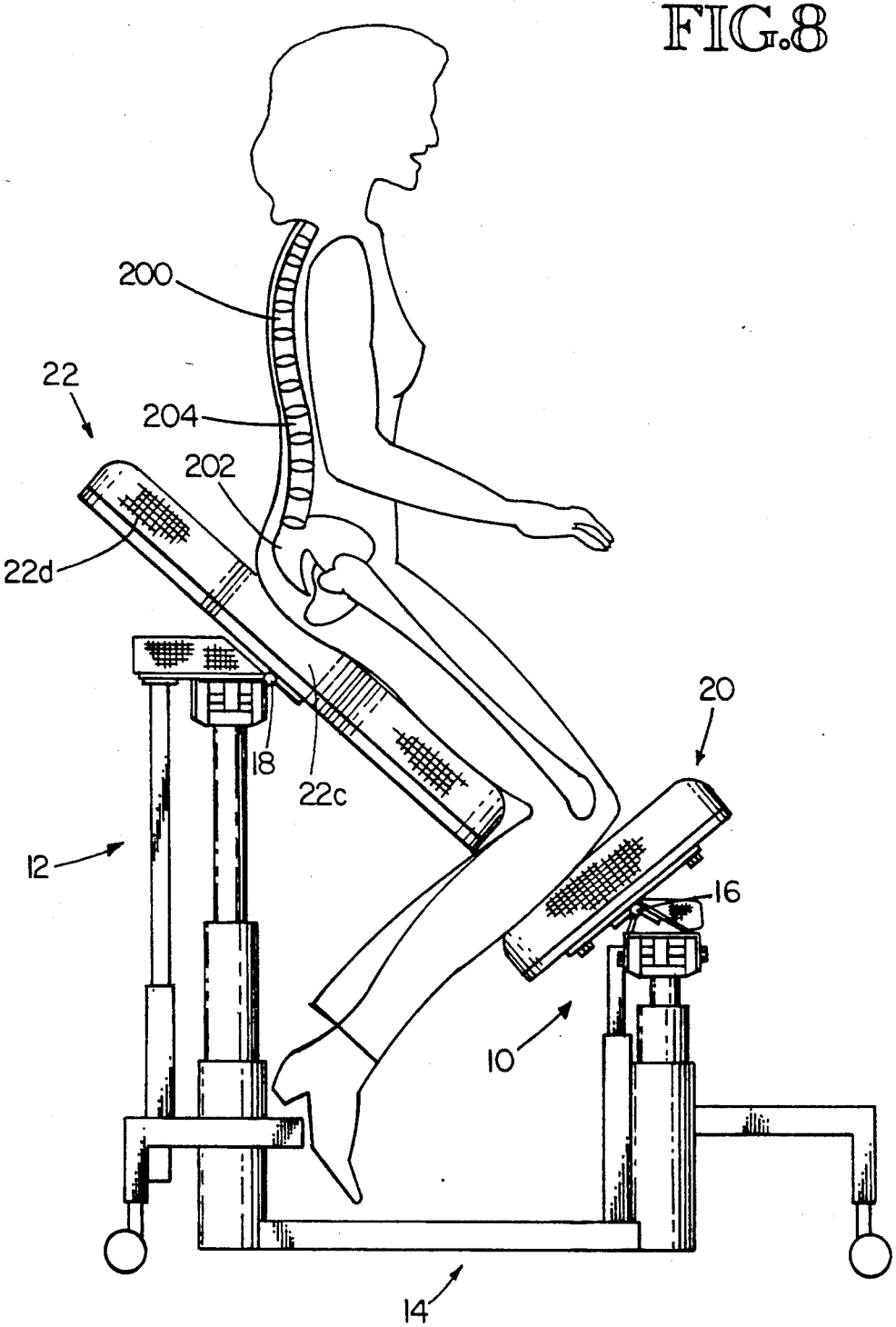
FIG. 8 is a side elevation view of the FIG. 1 embodiment used in a "Balans" posture mode.

The FIG. 2 rear cushion 122*b* is rectangular and relatively narrow in width while relatively longer is length to accomplish the above posture features. The FIG. 1 cushion 22*b* is provided with relatively narrow upper and lower ends, 22*d*–22*e*, to accomplish these posture features. The FIG. 1 cushion 22*b* also is provided with a wider mid-portion 22*c* that would support more buttocks flesh and the seat bones of a worker when he or she assumed the "Balans" posture as shown in FIG. 8. In the FIG. 8 "Balans" posture with the FIG. 1 rear cushion 22*b* configuration, the lower portion 22*e* narrowness of the cushion permits the worker's thighs to extend, uncontacted; that is to say, the worker's thighs do not bear against the rear cushion 22*b*. The lower portion narrowness permits the worker's calves, ankles and feet to clear the cushion when the worker assumes a sharper-angled "Balans" posture. Also, because of the location of the wider mid-portion 22*c*of the FIG. 1 rear cushion 22*b*, as shown in FIG. 8, the worker's sacrum and pelvis are adequately supported.

As shown in FIG. 7, the front seat is located far enough forward that the worker's seat bones are also clear of the front seat cushion. It would be an easy enough matter for the operator to adjust the front seat so that his or her seat bones could also be supported be the front seat cushion. Because the front and rear seat assemblies are independently supported from the base assembly, such relative adjustment is possible with the concommitant result that the front seat cushion relative to a worker's individual anatoxy can be satisfactorily changed. And yet as shown in FIG. 8, the same chair structure accomodates use in the "Balans" seating mode. It has been observed that in many cases no height adjustment is necessary to change postures. The only adjustment necessary to effect the different seating mode in other cases is relative height adjustment of the front and rear seats. For example, if a worker was working at both a drafting table and a computer terminal, it would be possible with the chair of the present invention to assume a "Balans" posture at the drafting table and a "Grandjean" or "Mandal" posture at the computer terminal, without making any height adjustments; the worker would simply reposition himself or herself.

It is possible to also use the chair of this invention in a combination of postures when a worker intends to sit on the front seat and recline his or her back against the rear seat. The chair of this invention could be used with a forward tilting front seat (a la "Mandal") and with a backward tilting rear seat (a la "Grandjean"). Likewise, the chair could be used with a rearward tilting front seat and an upright rear seat, or with a horizontal front seat and a backward tilted rear seat. With a worker seated in the chair of this invention having a dynamic range of tilting movements (unrestricted by any tilt-locking mechanism), any of these postures and more can be selected by the worker simply by he or she shifting his or her seat position relative to the front seat; and also, perhaps in some cases, adjusting the front-to-rear location of the front seat relative to the rear seat.

The front and rear seat assemblies may incorporate seat positioning, or tilt-locking mechanisms whereby particular tilt angles of the front and rear seats may be fixed so that a worker can get up and return to the same exact seating posture if so desired. This could be accomplished with respect to either seat, for example, by mounting an indexing plate, to one of the seat and hinge plates, to pivot relative to an indexing pin, mounted to the other of the seat and hinge plates, as the seat tilt angle is adjusted; the pin securely engaging the indexing plate to fix the seat at a desired tilt angle. In practice, however, the freely tiltable seats are preferred by a worker since he or she will quickly become used to sitting on the front seat and reclining to position his or her back against the rear seat in the same posture repeatedly without having the tilt angles pre-fixed.

Figure 9:
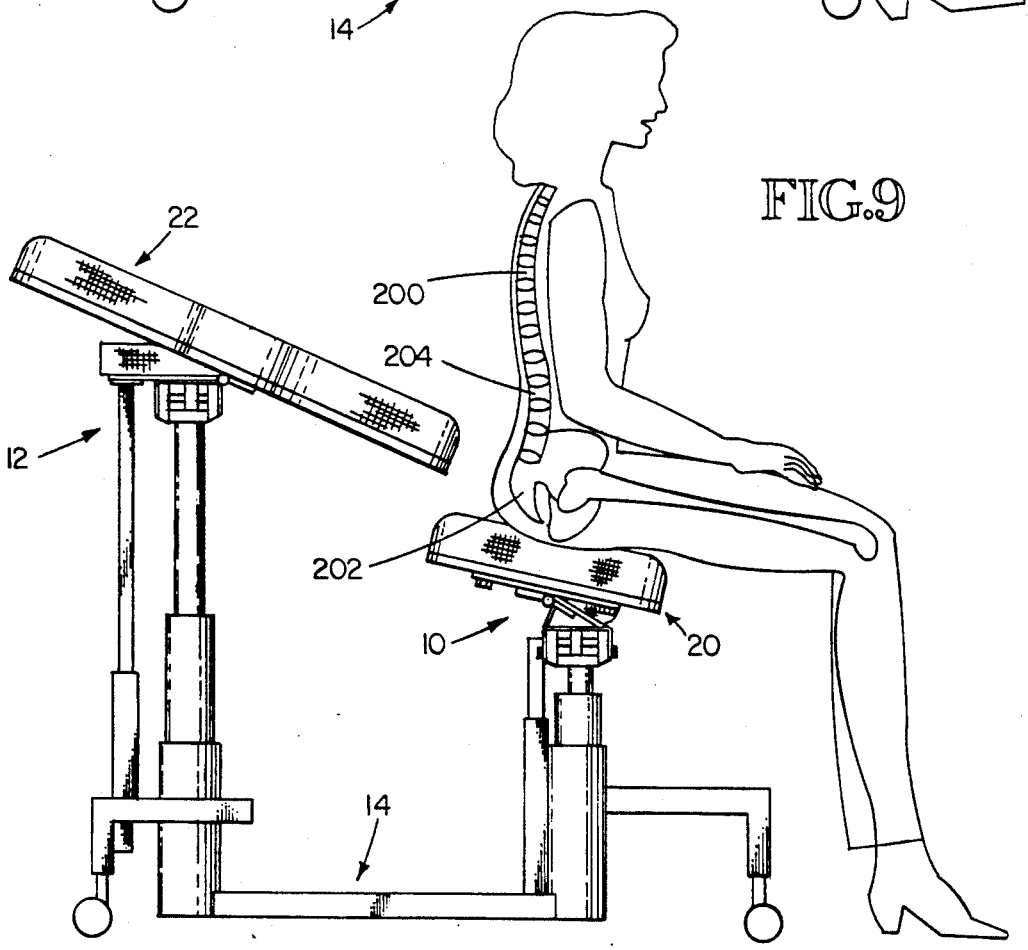
FIG. 9 is a side elevation view of the FIG. 1 embodiment used in a "Mandal" posture mode.

The design of the chair permits a worker to assume the various postures shown in FIGS. 7-9. The facts that the front and rear seat assemblies are adjustable vertically in relation to one another, and that the front seat assembly is adjustable toward and away from the rear seat assembly, enhance the capabilities of each of the various postures shown in FIGS. 7-9. In practice, the preferred vertical adjustment of the front seat from the floor to the front seat fulcrum point is between about 12 to 22 inches, with a typical elevation being about 17 inches; the preferred vertical adjustment of the rear seat from the floor to the rear seat fulcrum point is between about 18 to 33 inches, with a typical elevation being about 25 inches; and, while the front seat fore-to-aft adjustment is about 5 inches, a comfortable adjustment for a typical user would be between about 2-4 inches. A typical front seat length, front to back, would be between about 10 to 15 inches, about 10 inches being quite comfortable; and a typical rear seat length would be between about 22 to 28 inches, about 24 inches being quite comfortable.

All three postures, as well as an upright posture where the front cushion is horizontal and the rear cushion is vertical, and many others are available depending on the needs of the user. For example, a person may desire to arrange himself in the chair tilting the front and rear seat cushions backward to what might be called a "lounging" position with full back support, in which case the person's feet may or may not engage the front foot rail.

In The FIG. 7 useage of the chair of this invention, the position of the rear seat, when used as a back rest by a sitting worker, depends on the relative heights of the two fulcrum points and on where the sitter locates his or her seat on the chair seat. For example, if the sitter locates his or her seat on the chair seat so that the chair seat tends to assume a rearward-tilted position, the sitter's back will fall back against the rear seat (back rest) as the sitter sits in the chair, and the seat back will bear against the sitter's back at a backward tilted angle in the modified "Grandjean" posture shown in FIG. 7. The rear seat has a sufficient length, above and below its fulcrum point, that the sitter's back in the present example will be contacted and supported by the rear seat above and below the rear seat fulcrum point 18; more particularly, the sitter's dorsal region 200 will be contacted and supported above this fulcrum point and the sitter's sacrum region 202 will be contacted and supported below this fulcrum point. Consequently, as the sitter sits back in the chair, against the rear seat (back rest), the sitter's upper back will contact the upper portion of the rear seat and lever it about the rear seat fulcrum point into supporting contact with the sitter's lower back. As a worker engages in the work at hand, he or she will naturally adjust and change sitting positions, often times only very slightly. As a consequence of the interrelationship of the front and rear seat fulcrum points, the worker's sacrum region will be supported, the worker's own back serving to actuate a levering action of the rear seat about its fulcrum point to apply forward pressure on the worker's sacrum region. If the worker shifts forward on the front seat, the front seat will rotate forwardly about its fulcrum point and the rear seat will rotate rearwardly about its fulcrum point, and the lower part of the rear seat will still be levered against the worker's sacrum region. (If the worker causes the seat pan to assume a horizontal position and the back seat to assume a rearward inclination position, he or she has assumed the classic "Grandjean" posture). If the worker shifts rearward on the front seat, the front seat will rotate rearwardly about its fulcrum point and the rear seat will rotate forwardly about its fulcrum point, and the lower part of the rear seat will still be levered against the worker's buttocks (sacrum) region. The worker's sacrum region is at all times contacted by the lower end of the rear seat when the worker sits back against the rear seat (back rest). The spine in worker's lumbar region 204, in this modified "Grandjean" posture will be flattened somewhat from a condition of lordosis but the support of the worker's sacrum, provided by the upper seat back section levering the lower seat back section into bearing contact with the sacrum, appears to offset the flattening and provide a very comfortable posture.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. An adjustable chair comprising front seat assembly means, rear seat assembly means, and base assembly means, the base assembly means supporting the front and rear seat assembly means independently of one another; said front seat assembly means having a front seat pivotally mounted for rotation about a horizontal axis, said axis defining a front seat fulcrum; and said rear seat assembly means having a rear seat pivotally mounted for rotation about a horizontal axis, said axis defining a rear seat fulcrum; the two rotation axes being separated from one another a sufficient distance that a person may sit on the front seat and position his or her back against the rear seat; said front seat having a configuration adapted to support a sitting person and being so configured and positioned with respect to said rear seat whereby a sitting person may be supported by the front and rear seats with his or her sacrum, coccyx and ischial tuberosities clear of bearing contact with said front seat; said rear seat being provided with a rear seat cushion having a length sufficient below its horizontal axis of rotation to support the spinal dorsal region of a person sitting in the chair and a length sufficient above its horizontal axis of rotation to support the spinal dorsal region of a person sitting in the chair whereby a sitting person's spinal sacrum region will be supported as a result of a sitting person's upper back levering said rear seat into contact with the sitting person's sacrum region; said rear seat cushion being configured to provide an elongated narrow portion extending above its horizontal axis of rotation and to provide a wider mid portion adjacent the region of its horizontal axis of rotation, whereby said rear seat cushion may support a sitting person's upper and lower back regions without contacting his or her shoulders.

2. An adjustable chair comprising front seat assembly means, rear seat assembly means, and base assembly means, the base assembly means supporting the front and rear seat assembly means independently of one another; said front seat assembly means having a front seat pivotally mounted for rotation about a horizontal axis, said axis defining a front seat fulcrum; and said rear seat assembly means having a rear seat pivotally mounted for rotation about a horizontal axis, said axis defining a rear seat fulcrum; the two rotation axes being separated from one another a sufficient distance that a person may sit on the front seat and position his or her back against the rear seat; said rear seat having a length sufficient below its horizontal axis of rotation to support the spinal sacrum region of a person sitting in the chair and a length sufficient above its horizontal axis of rotation to support the spinal dorsal region of a person sitting in the chair whereby a sitting person's spinal sacrum region will be supported as a result of a sitting person's upper back levering said rear seat into contact with the sitting person's sacrum region; front seat mounting means mounting said front seat assembly means to said base assembly means whereby said front seat assembly means is vertically adjustable; and including rear seat mounting means mounting said rear seat assembly means to said base assembly means whereby said rear seat assembly means is vertically adjustable; and including anti-rotation means cooperatively associated with both seat mounting means so that said front and rear seats will not swivel about when vertically adjusted whereby the front and rear seats will remain stably oriented with respect to one another; said front seat mounting means comprising vertically-oriented gas lift column means having lever-actuated gas flow control means constructed and arranged whereby applied downward force to said front seat can result in said front seat being lowered vertically and whereby elimination of applied downward force to said front seat can result in said front seat being raised vertically; and wherein said rear seat mounting means comprises vertically-oriented gas lift column means having lever-actuated gas flow control means constructed and arranged whereby applied downward force to said rear seat can result in said rear seat being lowered vertically and whereby elimination of applied downward force to said rear seat can result in said rear seat being raised vertically whereby the front and rear seats can be vertically adjusted independently of one another and whereby the relative lateral distance between the front and rear seats will remain unchanged as the seats are raised or lowered.

3. The chair of claim 2 wherein said front seat mounting means includes resilient front spring means positioned whereby said front seat may bear thereagainst for resilient support and shock absorption; and wherein said rear seat mounting means includes resilient rear spring means positioned whereby said rear seat may bear thereagainst for resilient support and shock absorption.

4. The chair of claim 2 wherein said base assembly means includes a positioning member that spaces said rear seat assembly means rearward of said front seat assembly means; said positioning member being positioned at the bottom of said chair and so constructed and arranged whereby a person can step between the front and rear seat assembly means with minimal interference from said base assembly means when intending to position himself or herself in a Balans seating posture or in a standing seat posture.

5. The chair of claim 2 wherein said rear seat includes a rear seat cushion so constructed and arranged as to provide an elongated narrow portion extending above its horizontal axis of rotation, whereby said rear seat cushion may support a sitting person's upper and lower back regions without contacting his or her shoulders whereby a sitting person may pivot his or her shoulder without interference from said rear seat.

6. The chair of claim 2 wherein said base assembly means includes lateral stabilizing means to support said front and rear seat assembly means from a floor.

7. The chair of claim 6 wherein said lateral stabilizing means includes a foot rail so constructed and arranged that a sitting person can place his or her feet on said foot rail for leg support.

8. The chair of claim 2 including means for laterally adjusting the horizontal spacing between the front and rear seats whereby the relative lateral spacing therebetween can be varied.

9. The chair of claim 2 wherein said front seat is provided with a front seat cushion having a pair of lobes projecting rearward a sufficient distance to support the thighs of a sitting person up to a point adjacent to his or her ischial tuberosities.

10. An adjustable chair comprising front seat assembly means, rear seat assembly means, and base assembly means, the base assembly means supporting the front and rear seat assembly means independently of one another; said front seat assembly means having a front seat pivotally mounted for rotation about a horizontal axis, said axis defining a front seat fulcrum; and said rear seat assembly means having a rear seat pivotally mounted for rotation about a horizontal axis, said axis defining a rear seat fulcrum; the two rotation axes being separated from one another a sufficient distance that a person may sit on the front seat and position his or her back against the rear seat; said rear seat having a length sufficient below its horizontal axis of rotation to support the spinal sacrum region of a person sitting in the chair and a length sufficient above its horizontal axis of rotation to support the spinal dorsal region of a person sitting in the chair whereby a sitting person's spinal sacrum region will be supported as a result of a sitting person's upper back levering said rear seat into contact with the sitting person's sacrum region; front seat mounting means mounting said front seat assembly means to said base assembly means whereby said front seat assembly means is vertically adjustable; rear seat mounting means mounting said rear seat assembly means to said base assembly means whereby said rear seat assembly means is vertically adjustable; said front seat mounting means including resilient front spring means positioned whereby said front seat may bear thereagainst for resilient support and shock absorption; said rear seat mounting means including resilient rear spring means positioned whereby said rear seat may bear thereagainst for resilient support and shock absorption; said rear seat mounting means further including vertically-oriented gas lift column means having lever-actuated gas flow control means constructed and arranged whereby applied downward force to said front seat can result in said rear seat being lowered vertically and whereby elimination of applied downward force to said rear seat can result in said rear seat being raised vertically; and including anti-rotation means cooperatively associated with the rear seat mounting means so that said rear seat will not swivel about when vertically adjusted whereby the front and rear seats will remain stably oriented with respect to one another.

11. The chair of claim 10 wherein said base assembly means includes a positioning member that spaces said rear seat assembly means rearward of said front seat assembly means and is so constructed and arranged whereby a person can step between the front and rear seat assembly means with minimal interference from said base assembly means when intending to position himself or herself in the Balans seating posture or in the standing seat posture.

12. The chair of claim 10 wherein said rear seat includes a rear seat cushion so constructed and arranged as to provide an elongated narrow portion extending above its horizontal axis of rotation, whereby said rear seat cushion may support a sitting person's upper and lower back regions without contacting his or her shoulders whereby a sitting person may pivot his or her shoulder without interference from said rear seat.

13. The chair of claim 10 wherein said base assembly means includes lateral stabilizing means to support said front and rear seat assembly means from a floor.

14. The chair of claim 13 wherein said lateral stabilizing means includes a foot rail so constructed and arranged that a sitting person can place his or her feet on said foot rail for leg support.

15. The chair of claim 10 including means for laterally adjusting the horizontal spacing between the front and rear seats whereby the relative lateral spacing therebetween can be varied.

16. An adjustable chair comprising front seat assembly means, rear seat assembly means, and base assembly means, the base assembly means supporting the front and rear seat assembly means independently of one another; said front seat assembly means having a front seat pivotally mounted for rotation about a horizontal axis, said axis defining a front seat fulcrum; and said rear seat assembly means having a rear seat pivotally mounted for rotation about a horizontal axis, said axis defining a rear seat fulcrum; the two rotation axes being separated from one another a sufficient distance that a person may sit on the rear seat and position his or her back against the front seat; front seat mounting means mounting said front seat assembly means to said base assembly; and rear seat mounting means mounting said rear seat assembly means to said base assembly means; said rear seat mounting means pivotally-mounting said seat and being so constructed and arranged that said rear seat normally rotates forward and assumes a vertical position whereby a person can step between the front and rear seat assembly means with minimal interference from said rear seat; front seat mounting means mounting said front seat assembly means to said base assembly means whereby said front seat assembly means is vertically adjustable; and including rear seat mounting means mounting said rear seat mounting means to said base assembly means whereby said rear seat assembly means is vertically adjustable; anti-rotation means cooperatively associated with both seat mounting means so that said front and rear seats will not swivel about when vertically adjusted whereby the front and rear seats will remain stablely oriented with respect to one another; said front seat mounting means comprising vertically-oriented gas lift column means having lever-actuated gas flow control means constructed and arranged whereby applied downward force to said front seat can result in said front seat being lowered vertically and whereby elimination of applied downward force to said front seat can result in said front seat being raised vertically; and wherein said rear seat mounting means comprises vertically-oriented gas lift column means having lever-actuated gas flow control means constructed and arranged whereby applied downward force to said rear seat can result in said rear seat being lowered vertically and whereby elimination of applied downward force to said rear seat can result in said rear seat being raised vertically whereby the front and rear seats can be vertically adjusted independently of one another and whereby the relative lateral distance between the front and rear seats will remain unchanged as the seats are raised or lowered.

17. The chair of claim 16 wherein said front seat mounting means includes resilient front spring means positioned whereby said front seat may bear thereagainst for resilient support and shock absorption; and whereby said rear seat mounting means includes resilient rear spring means positioned whereby said rear seat may bear thereagainst for resilient support and shock absorption.

18. The chair of claim 16 wherein said base assembly means includes a positioning member that spaces said rear seat assembly means rearward of said front seat assembly means; said positioning member being positioned at the bottom of said chair and so constructed and arranged whereby a person can step between the front and rear seat assembly means with minimal interference from said base assembly means when intending to position himself or herself in a Balans seating posture or in a standing seat posture.

19. The chair of claim 16 including means for laterally adjusting the horizontal spacing between the front and rear seats whereby the relative lateral spacing therebetween can be varied.

20. An adjustable chair comprising front seat assembly means, rear seat assembly means, and base assembly means, the base assembly means supporting the front and rear seat assembly means independently of one another; said front seat assembly means having a front seat pivotally mounted for rotation about a horizontal axis, said axis defining a front seat fulcrum; and said rear seat assembly means having a rear seat pivotally mounted for rotation about a horizontal axis, said axis defining a rear seat fulcrum; the two rotation axes being separated from one another a sufficient distance that a person may sit on the rear seat and position his or her knees against the front seat; the rear seat being provided with a rear seat cushion configured to provide a narrow portion extending below its horizontal axis of rotation and to provide a wider mid portion adjacent the region of its horizontal axis of rotation, whereby a person may sit on the rear seat wider mid portion with his or her thighs extending on either side of the rear seat narrow portion.

21. The chair of claim 20 wherein said front seat is provided with a front seat cushion having a pair of lobes projecting rearward a sufficient distance to support the knees and lower legs of a sitting person.

22. The chair of claim 20 including rear seat mounting means mounting said rear seat assembly means to said base assembly means whereby said rear seat assembly means is vertically adjustable; said rear seat mounting means including vertically-oriented gas lift column means having lever-actuated gas flow control means constructed and arranged whereby applied downward force to said rear seat can result in said rear seat being lowered vertically and whereby elimination of applied downward force to said rear seat can result in said rear seat being raised vertically; and including anti-rotation means cooperatively associated with the rear seat mounting means so that said rear seat will not swivel about when vertically adjusted whereby the front and rear seats will remain stably oriented with respect to one another.

* * * * *